US012758819B2

(12) United States Patent
Lohrengel et al.

(10) Patent No.: US 12,758,819 B2
(45) Date of Patent: Oct. 13, 2026

(54) USER-CUSTOMIZABLE ERGOMETER

(71) Applicant: Anmelder: TECHNISCHE UNIVERSITÄT CLAUS-THAL, Clausthal-Zellerfeld (DE)

(72) Inventors: Armin Lohrengel, Osterode (DE); Viktor Martinewski, Clausthal-Zellerfeld (DE); Elke Maume, Nordharz OT Stapelburg (DE)

(73) Assignee: TECHNISCHE UNIVERSITAET CLAUSTHAL, Clausthal-Zellerfeld (DE)

( * ) Notice: Subject to any disclaimer, the term of this patent is extended or adjusted under 35 U.S.C. 154(b) by 256 days.

(21) Appl. No.: 18/290,870

(22) PCT Filed: Jul. 6, 2022

(86) PCT No.: PCT/EP2022/068693
§ 371 (c)(1),
(2) Date: Aug. 7, 2024

(87) PCT Pub. No.: WO2023/025445
PCT Pub. Date: Mar. 2, 2023

(65) Prior Publication Data

US 2025/0288863 A1 Sep. 18, 2025

(30) Foreign Application Priority Data

Aug. 25, 2021 (DE) ..... 102021121992.2

(51) Int. Cl.
*A63B 22/06* (2006.01)

(52) U.S. Cl.
CPC ..... *A63B 22/0605* (2013.01); *A63B 2225/09* (2013.01)

(58) Field of Classification Search
CPC ..... A63B 22/0605; A63B 2225/09; A63B 2225/096; A63B 2225/20; A63B 2225/50; A63B 21/0083; A63B 21/4035
See application file for complete search history.

(56) References Cited

U.S. PATENT DOCUMENTS 9,868,028 B2 1/2018 Shin
9,873,014 B1 * 1/2018 Kuo ..... A63B 22/0015
(Continued)

*Primary Examiner* — Sundhara M Ganesan
(74) *Attorney, Agent, or Firm* — Andrew Wilford

(57) ABSTRACT

An ergometer (1) has a saddle, the saddle support point position (2) of which is adjustable in the vertical direction (y) and longitudinal direction (x) of the ergometer (1), a handlebar, the handlebar position (9) of which is adjustable in the vertical direction (y) and longitudinal direction (x) of the ergometer (1), a pedal part (15), the bottom bracket shaft (14) of which is arranged fixedly on the ergometer, and an adjustment device (5) by means of which the saddle support point position (2) and the handlebar position (9) can be set. In order with minimum effort to perfectly set the ergometer to the individual anatomical dimensions of a person using the ergometer (1), it is proposed that the adjustment device (5) has a control device (21) by means of which the adjustment device (5) can be automatically motor-operated corresponding to predetermined setpoint values for the saddle support point position (2) and the handlebar position (9), and that the predetermined setpoint values for the saddle support point position (2) and the handlebar position (9) can be individually calculated for a person in a computing unit (22) from ergonomic data of said person that are recorded by means of an external device unit (23).

12 Claims, 2 Drawing Sheets

(56) References Cited

U.S. PATENT DOCUMENTS

| | | | | |
|---|---|---|---|---|
| 11,684,819 | B2 | 6/2023 | Hawkins | |
| 2006/0189440 | A1 | 8/2006 | Gravagne | |
| 2008/0058170 | A1* | 3/2008 | Giannascoli | A63B 69/16 482/57 |
| 2011/0077125 | A1* | 3/2011 | Kenyon | A63B 22/0605 482/4 |
| 2013/0065733 | A1* | 3/2013 | Kautz | A63B 22/0605 482/57 |
| 2014/0221158 | A1* | 8/2014 | Mabey | A63B 22/0046 482/4 |
| 2014/0379135 | A1* | 12/2014 | Kristiansen | G05B 13/02 700/275 |
| 2015/0246264 | A1* | 9/2015 | Lampert | A63B 24/0087 482/4 |
| 2018/0111017 | A1* | 4/2018 | Nelson | A63B 22/001 |
| 2021/0060380 | A1* | 3/2021 | Hawkins, III | A63B 21/005 |

* cited by examiner

USER-CUSTOMIZABLE ERGOMETER

CROSS REFERENCE TO RELATED APPLICATIONS

This application is the US-national stage of PCT application PCT/EP2022/068693 filed 6 Jul. 2022 and claiming the priority of PCT patent application PCT/EP2022/068693 itself filed 6 Jul. 2022.

The invention relates to an ergometer having a saddle whose support-point position is adjustable in height as well as in a length direction of the ergometer, a handlebar whose position is adjustable in a height as well as in a length direction of the ergometer, a pedal assembly whose crankshaft is mounted so as to be fixedly attached to the ergometer, and an adjuster that can set the saddle support-point position and the handlebar position.

Such ergometers are used in a variety of ways, such as in private premises or gyms, training centers or the like.

In light of the different ergonomic parameters of the users of such ergometers, it is often necessary or recommended to adjust the ergometer in order to take into account the ergonomic data of the user. This entails the expenditure of a considerable amount of effort for the various settings of the ergometers, in particular in cases of ergometers used by numerous people.

Based on the state of the art outlined above, the underlying object of the invention is to improve a generic ergometer in such a manner that it adapts virtually automatically to the individual anatomical parameters of a person who wants to be the next person to use the ergometer with the expenditure of considerably less effort.

This object is attained according to the invention in that the adjuster of the ergometer has an internal controller that can automatically operate the ergometer by motors according to predetermined target values for the saddle support-point position and the handlebar position, and where the predetermined target values for the saddle support-point position and the handlebar position can be evaluated in a computing unit individually for a person from ergonomic data captured by an external controller for that person. It is thus possible to transmit ergonomic data of the person who intends to use the ergometer to the computing unit from the external controller of that person. In the computing unit, the saddle support-point position and the handlebar position that are optimal for the person in question are calculated from the ergonomic data of that person. This saddle support-point position and handlebar position are used as target values as a basis for the operation of the operator of the ergometer, for setting the saddle support-point position and the handlebar position of the ergometer optimally for the above-mentioned person. The ergometer is now, i.e. following setting of the saddle support-point position and the handlebar position, adapted in an excellent manner to the ergonomic parameters of the person who intends to use the ergometer.

A still further improved adaptation of the ergometer to the user in particular in terms of force transmission characteristics is achievable when a crank length of the pedal assembly is adjustable by the adjuster of the ergometer according to a target value calculated in the computing unit from the ergonomic data captured by the external controller. This allows the crank length of the pedal assembly to be optimally adapted to the leverage ratios of the person using the ergometer.

The ergometer according to the invention can be realized in a particularly simple manner when the external controller is a smartphone. Both the computing unit used to operate the ergometer according to the invention and the capture of the ergonomic data can advantageously be realized in the form of an app that is installable on a smartphone.

Alternatively, it is possible to design the computing unit as part of the internal controller on the ergometer, wherein in this case the ergonomic data of the person intending to use the ergometer is transmitted to the computing unit from the external controller or smartphone.

Any desired adjustment of the saddle support-point position of the ergometer is achievable in a less complex manner in terms of technical design when the adjuster has a first actuator for adjusting the saddle support-point position in a vertical direction of the ergometer and a second actuator for adjusting the saddle support-point position in a horizontal direction of the ergometer.

With respect to the requirements profile of the two actuators, it is advantageous when the first actuator is a linear actuator and the second actuator is a rotary actuator.

Any desired positioning of the handlebar position of the ergometer according to the invention can accordingly be achieved with comparatively little expenditure in terms of technical design when the adjuster has a third actuator for adjusting the handlebar position in a vertical direction of the ergometer and a fourth actuator for adjusting the handlebar position in a horizontal direction of the ergometer. This allows the handlebar position to be set in virtually any desired manner with comparatively little expenditure.

It is also expedient for the third and fourth actuators to make the third actuator as a linear actuator and the fourth actuator a rotary actuator.

Since the telescoping actuator whose free end defines the saddle point is pivoted by the second actuator for adjustment or pivoting about a first pivot axis by the second actuator, and a further telescopic tube assembly whose free end defines the handlebar position can adjust or pivot about a further pivot axis 12 by the fourth actuator, the angle comprised by the two telescopic tube assemblies or their extension axes can be adapted in virtually any desired manner to all ergonomic requirements.

The adjustment of the crank length of the pedal assembly of the ergometer is achievable with comparatively little expenditure in terms of technical design when the adjuster of the pedal assembly has an electric motor connected to the internal controller and serving to adjust the spacing between a foot pedal of the pedal assembly and the crankshaft of the pedal assembly, the latter being fixedly attached via a gear to the ergometer.

The gear of the actuator associated with the pedal assembly is expediently self-locking, expediently as a harmonic-drive gear or as a worm gear.

To simplify the setting of the pedal assembly of the ergometer according to the invention, it is advantageous when the adjustment of both crank sides of the pedal assembly can be realized synchronously and mirror-symmetrically.

An optimum setting of the ergometer to the ergonomic parameters of the user is advantageously achievable when the external controller captures the inside leg length, torso length, body length, arm length, lower leg length, upper leg length, foot length, effective foot length, shoulder width and/or weight of the person using the ergometer as ergonomic data.

The invention is described in more detail in the following based on an embodiment and with reference to the drawing in which.

Figure 1:
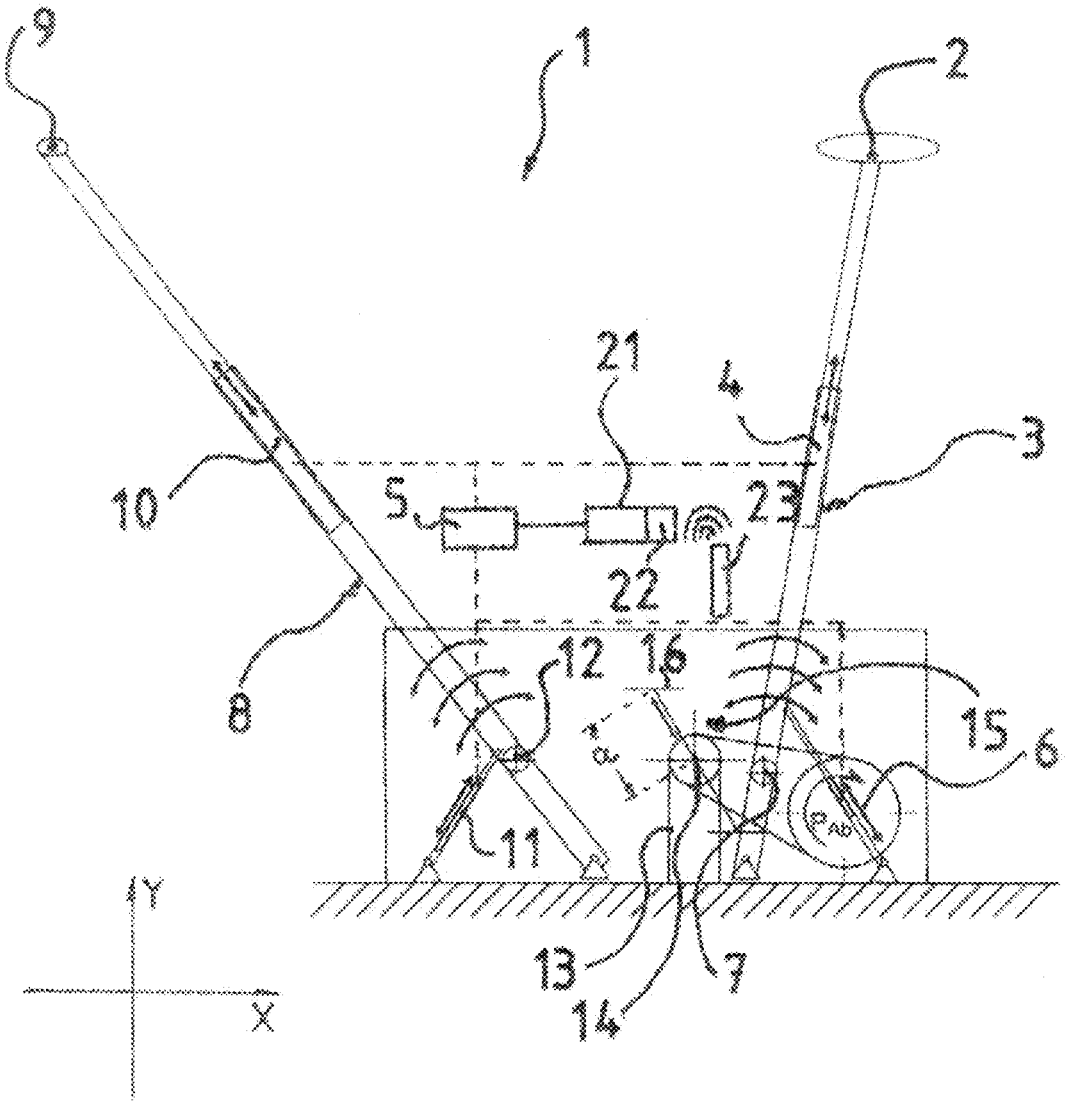
FIG. 1 is a schematic view of an embodiment of an ergometer according to the invention.

An embodiment of an ergometer 1 according to the invention shown schematically in FIG. 1 is usually used for sports training.

FIG. 1 is a schematic view of the ergometer 1 showing FIG. 1 that it has a saddle support-point position 2 where a saddle (not shown in the figures) can be fixed. A wide variety of saddle types can be at the saddle support-point position 2.

In the case of the illustrated embodiment of the ergometer 1, the saddle support-point position 2 is determined by the upper end of a telescopic tube assembly 3. The telescopic tube assembly 3 is adjustable with respect to its longitudinal extension by a first actuator 4 schematically shown by an arrow in FIG. 1. This first actuator 4 is connected to an operator 5 of the ergometer 1 via a connection shown as a dashed line in FIG. 1.

A second actuator 6 also indicated by an arrow is associated with the telescopic tube assembly 3 and is also connected to the operator 5 of the ergometer 1 via a connection shown as a dashed line in FIG. 1. The telescopic tube assembly 3 is pivotable about a pivot axis 7 by the second actuator 6.

The first actuator 4 and the second actuator 6, both of which are connected to the operator 5 of the ergometer 1 allow the saddle support-point position 2 of the ergometer 1 to assume virtually any appropriate position during operation of the ergometer both in the x direction as well as in the y direction where, as is evident from FIG. 1, the y direction corresponds to the vertical direction and the x direction corresponds to the horizontal length direction of the ergometer 1.

The ergometer 1 shown schematically in FIG. 1 includes a further telescopic tube assembly 8 whose upper end determines a handlebar position 9 of the ergometer 1. The telescopic tube assembly 8 associated with the handlebar position 9 has a third actuator 10 serving serves to adjust the length of the third telescopic tube assembly 8 that is connected to the operator 5 of the ergometer 1 by a coupling also illustrated as a dashed line in FIG. 1. A handlebar of the ergometer 1 is at the handlebar position 9, this handlebar being of any of a wide variety of types.

Moreover, the further telescopic tube assembly 8 includes a fourth actuator 11 having a further telescopic tube assembly 8 whose upper end determines the handlebar position 9 that in FIG. 1 is pivotable about a pivot axis 12. Both the third actuator 10 and the fourth actuator 11 are indicated in FIG. 1 by arrows and, as already mentioned, are connected to the operator 5 of the ergometer 1 via a connection shown as a dashed line in FIG. 1.

The third actuator 10 and the fourth actuator 11 can set the handlebar position 9 in virtually any manner with respect to the height direction y and the length direction x of the ergometer 1 analogously to the saddle support-point position 2.

As it is possible to adjust or pivot the telescopic tube assembly 3 about the pivot axis 7 by the second actuator 6 and the further telescopic tube assembly 8 about the pivot axis 12 by the fourth actuator 11 separately from each other, the angle comprised by the two telescopic tube assemblies 3, 8 can be set in virtually any manner to all ergonomic requirements.

The ergometer 1 also has a pedestal 13 on which is fixed a crankshaft 14 of a pedal assembly 15 of the ergometer 1.

In the embodiment of the ergometer according to the invention shown in FIG. 1, the pedal assembly 15 has an adjustable crank length a whose adjustability is explained in the following with reference to FIGS. 2 to 4. The crank length a corresponds to the spacing between the crankshaft 14 journaled in the pedestal 13 so as to be attached to the ergometer in a fixed manner on the one hand and a foot pedal 16 on the other.

Figure 2:
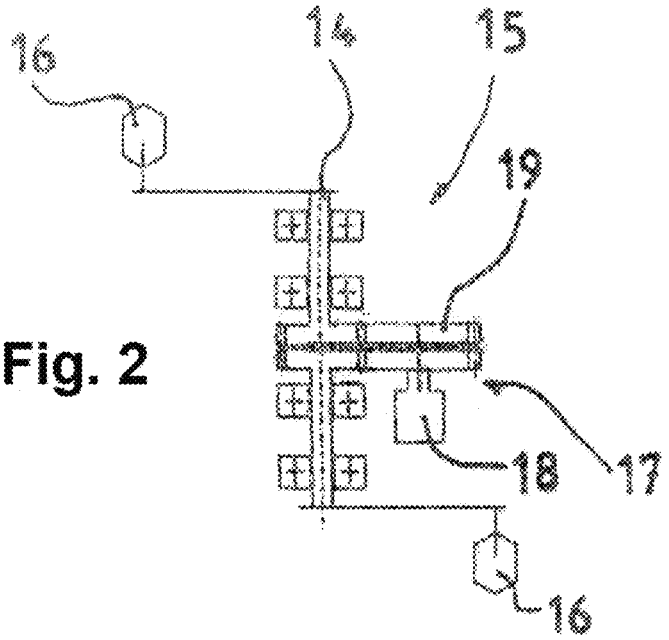
FIG. 2 is a top view of an embodiment of a pedal assembly of the ergometer according to the invention shown in FIG. 1.
Figure 3:
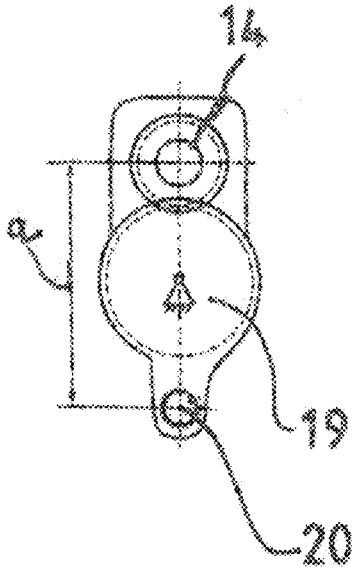
FIG. 3 is a schematic view of the pedal assembly shown in FIG. 2 in side view where the crank length is set to be as great as possible.
Figure 4:
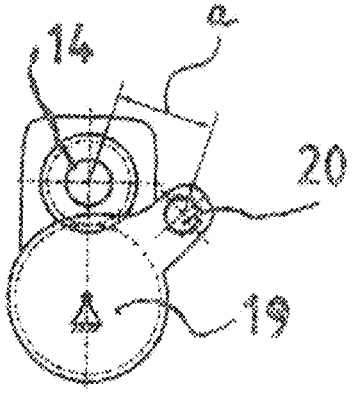
FIG. 4 is a view of the pedal assembly of FIG. 3 with a smallest possible crank length.

A fifth actuator 17 shown in more detail in FIGS. 2 to 4, is associated with the pedal assembly 15 and is also connected to the operator 5 of the ergometer 1 by a connection shown as a dashed line in FIG. 1.

The fifth actuator 17 includes an electric motor 18 and a gear 19 for adjusting the spacing between the crankshaft 14 of the pedal assembly 15 on the one hand and a pedal mount 20 in which the foot pedals 16 of the pedal assembly 15 are mounted on the other hand.

FIG. 3 shows the pedal assembly 15 with a large crank length a, whereas FIG. 4 shows the pedal assembly 15 with a small crank length a. The crank length of the pedal assembly 15 is virtually continuously adjustable by the electric motor and the gear 19 between these crank lengths a shown in FIG. 3 and FIG. 4.

The operator 5 of the ergometer 1 includes an internal controller 21 itself controlling the operator 5 and thereby the first actuator 4, the second actuator 6, the third actuator 10, the fourth actuator 11 and the fifth actuator 17. The control of this operator 5 and the actuators 4, 6, 10, 11, 17 associated therewith occurs according to predetermined target values for the saddle support-point position 2 and the handlebar position 9 as well as the crank length a. These target values for the saddle support-point position 2, the handlebar position 9 and the crank length a are calculated in a computing unit 22 from ergonomic data of a person individually for this person, where the transmission to the internal controller 21 or its computing unit 22 is realized by an external controller 23 associated with the person in question.

For example, a smartphone in which the above-mentioned ergonomic data of the owner of the smartphone is stored can be used as the external controller 23. A suitable app can be installed on a smartphone serving as the external controller 23 both for storing as well as for wirelessly transmitting the data to the computing unit 22.

In the embodiment of the ergometer according to the invention shown in FIG. 1, the computing unit 22 is part of the internal controller 21.

In the embodiment of the ergometer according to the invention shown in FIG. 1, the first actuator 4 provided for changing the length of the telescopic tube assembly 3 associated with the saddle support-point position 2 and the designated third actuator 10 for changing the length of the telescopic tube assembly 8 associated with the handlebar position 9 are linear actuators.

In the embodiment of the ergometer 1 according to the invention shown in FIG. 1, the second adjuster 6 associated with the pivoting of the telescopic tube assembly 3 associated with the saddle support-point position 2 about the pivot axis 7 and the fourth actuator 11 associated with the pivoting of the telescopic tube assembly 8 associated with the handlebar position 9 about the pivot axis 12 are rotary actuators.

The gear 19 that can set the crank length a in co-operation with the electric motor 18 of the fifth actuator 17 is a harmonic-drive gear in the illustrated embodiment of the ergometer according to the invention. Alternatively, it can also be a worm gear.

The adjustment of the crank length a on both crank sides of the pedal assembly 15 can accordingly be realized synchronously and mirror-symmetrically.

An optimal setting of the ergometer 1 to the user is possible when the inner leg length, torso length, body length, arm length, lower leg length, upper leg length, foot length, effective foot length, shoulder width and weight of the person are captured as ergonomic data.

The invention claimed is:

1. An ergometer comprising:

a saddle having a support-point position adjustable in height as well as in a length direction of the ergometer, a handlebar having a handlebar position adjustable in height as well as in the length direction of the ergometer, a pedal assembly having a variable crank length, at least one foot pedal, and a crankshaft rotatable about an axis fixed in the ergometer, an operator for setting the saddle support-point position, the crank length between the foot pedal and the crankshaft, and the handlebar position and that has an internal controller that can automatically actuate the operator with a motor according to predetermined target values for the saddle support-point position, the crank length, and the handlebar position, and a computing unit connected to the operator for calculating the predetermined target values for the saddle support-point position, the crank length and the handlebar position individually for a person from ergonomic data captured by an external controller for that person;

a gear connected to the crankshaft; and an electric motor in the operator and connected to the gear for adjusting the crank length between the foot pedal and the axis of the crankshaft.

2. The ergometer according to claim 1, wherein the external controller is a smartphone.

3. The ergometer according to claim 2, wherein the computing unit and the capture of the ergonomic data are realized in the form of an app on the smartphone.

4. The ergometer according to claim 1, wherein the computing unit is part of the internal controller.

5. The ergometer according to one of claim 1, wherein the operator has a first actuator for adjusting the saddle support-point position in a vertical direction of the ergometer and a second actuator for adjusting the saddle support-point position in a horizontal direction of the ergometer.

6. The ergometer according to claim 5, wherein the first actuator is a linear actuator and the second actuator is a rotary actuator.

7. The ergometer according to one of claim 1, wherein the operator has a third actuator for adjusting a handlebar position in a vertical direction of the ergometer and a fourth actuator for adjusting the handlebar position in a horizontal direction of the ergometer.

8. The ergometer according to claim 7, wherein the third actuator is a linear actuator and the fourth actuator is a rotary actuator.

9. The ergometer according to claim 1, wherein the gear is self-locking and is a harmonic-drive gear or a worm gear.

10. The ergometer according to claim 1, wherein adjustment of both crank sides of the pedal assembly is realized synchronously and mirror-symmetrically.

11. The ergometer according to claim 1, wherein the external controller captures the inside leg length, the torso length, the body length, the arm length, the lower leg length, the upper leg length, the foot length, the effective foot length, the shoulder width and/or the weight of the person using the ergometer as ergonomic data.

12. A method of using an ergomenter according to claim 1 and having a frame, a saddle supported on the frame and movable by actuators horizontally and vertically, a handle bar supported on the frame and movable by actuators horizontally and vertically, and a pedal assembly rotatable on the frame about an axis fixed on the frame, the method comprising the steps of;

providing a controller on the frame connected to the actuators of the saddle and handle bar for operating same;

recording anatomical parameters of a user of the device in a cell phone of the user;

transmitting the parameters wirelessly from the cell phone to the controller; and the controller receiving the parameters and operating the actuators in accordance therewith to custom fit the ergometer to the user.

* * * * *